US007069896B2

(12) United States Patent
Tsunoda et al.

(10) Patent No.: US 7,069,896 B2
(45) Date of Patent: Jul. 4, 2006

(54) RECOIL STARTER

(75) Inventors: Shuhei Tsunoda, Tokyo (JP); Toshinori Morishige, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 10/688,121

(22) Filed: Oct. 17, 2003

(65) Prior Publication Data

US 2004/0079313 A1 Apr. 29, 2004

(30) Foreign Application Priority Data

Oct. 21, 2002 (JP) ..... 2002-306298

(51) Int. Cl.
*F02N 3/02* (2006.01)

(52) U.S. Cl. ..... 123/185.3

(58) Field of Classification Search ..... 123/185.14, 123/185.2, 185.3, 185.4; 74/7 C; 192/42
See application file for complete search history.

(56) References Cited

U.S. PATENT DOCUMENTS 3,396,277 A 8/1968 Ayme de la Chevreliere
5,287,832 A 2/1994 Uhl
5,862,787 A * 1/1999 Unuma et al. ..... 123/185.3
6,588,390 B1 7/2003 Kawasaki et al.
6,739,303 B1 * 5/2004 Harada et al. ..... 123/185.14
2003/0094154 A1 5/2003 Morishige et al.
2003/0213455 A1 11/2003 Tohyama
2004/0016311 A1 1/2004 Hashiba

FOREIGN PATENT DOCUMENTS

JP 2-149872 12/1990
JP 6-16964 5/1994
JP 7-17810 4/1995
JP 2003-97397 A * 4/2004

* cited by examiner

*Primary Examiner*—Andrew M. Dolinar

(57) ABSTRACT

A recoil starter capable of introducing cooling air into an engine through the recoil starter and reducing a size and weight thereof. Annular recesses are formed in opposing joint surfaces of a rope reel and a cam, respectively, in a manner to face each other. A damper spring is received in the annular recesses while opposite ends thereof are respectively held at the rope reel and the cam so that the rope reel and the cam are rotationally coupled together via the damper spring. Air inlets for introducing air for cooling the engine are formed in a side wall of a casing. Air passages facing the air inlets of the casing are formed between a drum portion at an outer periphery of the rope reel and a boss portion forming the annular recess of the rope reel.

6 Claims, 5 Drawing Sheets

RECOIL STARTER

BACKGROUND OF THE INVENTION

1. Field of the Invention

The present invention relates to a recoil starter, wherein a recoil rope wound around a rope reel is pulled to rotate the rope reel so that a rotation of the rope reel is transmitted to a rotating member such as a drive pulley or the like coupled to a crankshaft of an engine via a ratchet mechanism, to thereby start the engine.

2. Description of the Related Art

Among recoil starters where a rotation of a rope reel rotated by pulling a recoil rope wound around the rope reel is transmitted to a cam, and a rotation of the cam is transmitted to a rotating member such as a flywheel magnet or a drive pulley coupled to a crankshaft of an engine via a clutch mechanism such as a centrifugal clutch, so that the crankshaft of the engine is rotated to start the engine, a recoil starter is known which is so constructed that the rope reel and the cam are resiliently coupled by a damper spring in the form of a spiral spring interposed between the rope reel and the cam, whereby the rotation of the rope reel is transmitted to the cam via the damper spring while shock to be transmitted to an operator's hand resulting from fluctuations of a load at the time the engine is started is absorbed (see, e.g., U.S. Pat. No. 5,287,832).

In this conventional technology, components constituting the recoil starter, such as the rope reel, the cam and the like, are received in a casing having a cup form. The casing is attached to the engine so as to face the crankshaft of the engine. There are problems in that, when the rope reel is formed to have a large outer diameter in order to reduce the pulling load of the recoil rope, the outer dimensions of the casing also becomes large, and when the casing is mounted to the engine, openings in the engine are blocked up, so that air for cooling the engine cannot be introduced into the inside of the engine, with the result that cooling of the engine cannot be efficiently conducted.

In this conventional technology, the cam rotated by the rope reel and the drive pulley attached to the crankshaft of the engine are disposed to face each other. Moreover, the clutch mechanism for transmitting the rotation of the cam to the drive pulley operates along the crankshaft so that mutually opposing end surfaces of the clutch mechanism and the drive pulley engage, whereby the rotation is transmitted to the drive pulley. Therefore, it is necessary to set the axial-direction dimension between the cam and the drive pulley to be large, leading to an increase in the dimension of the recoil starter in the axial direction, with the result that there is the problem that a reduction in size and weight cannot be achieved.

SUMMARY OF THE INVENTION

The present invention has been made in view of the foregoing problems.

Accordingly, it is an object of the present invention to provide a recoil starter enabling cooling air to be introduced into the inside of an engine through openings in the engine so that cooling of the engine can be efficiently conducted even when outer dimensions of a rope reel are designed to be large in order to reduce the pulling load of a recoil rope.

It is another object of the present invention to provide a recoil starter enabling the dimensions, particularly in the axial direction, of the recoil starter to be reduced so that size and weight reduction can be achieved.

In accordance with the present invention, there is provided a recoil starter. The recoil starter comprises: a casing including a reel shaft disposed coaxially with a crankshaft of an engine, which crankshaft has a rotating member coupled thereto; a rope reel rotatably supported on the reel shaft and provided at an outer periphery thereof with a drum portion around which a recoil rope is wound; a recoil spring for rotationally urging the rope reel in a direction in which the recoil rope is rewound; a cam, rotatably supported on the reel shaft, for transmitting a rotation thereof to the rotating member via a clutch mechanism; and a damper spring, disposed between the rope reel and the cam, for transmitting a rotation of the rope reel to the cam using a resilient action; wherein annular recesses are formed in mutually opposing joint surfaces of the rope reel and the cam, respectively, in a manner to face each other, the damper spring being received in the annular recesses while opposite ends of the damper spring are respectively held at the rope reel and the cam so that the rope reel and the cam are rotationally coupled together via the damper spring; the casing includes a side wall having air inlets formed therein for introducing air for cooling the engine; and the rope reel includes a boss portion which forms the annular recess of the rope reel, the rope reel having air passages which are formed between the drum portion and the boss portion thereof in such a manner as to face the air inlets formed in the casing.

Preferably, the clutch mechanism for transmitting the rotation of the cam to the rotating member comprises: a cam pawl formed projectingly on an outer peripheral surface of the cam; a drive pulley which constitutes the rotating member and which has a cup form with its one end open, the drive pulley being disposed in such a manner as to cover the cam; and a centrifugal ratchet having one end thereof pivotally supported at an annular flange which is formed on an open end portion of the drive pulley in a manner to project radially outward therefrom, the centrifugal ratchet being provided on the other end thereof with an engaging piece formed to be angled toward the inside of the drive pulley, the centrifugal ratchet being rotationally urged in a direction in which the engaging piece thereof engages with the cam pawl of the cam.

BRIEF DESCRIPTION OF THE DRAWINGS

The above and other objects, aspects, features and advantages of the present invention will become more apparent from the following detailed description when taken in conjunction with the accompanying drawings, in which.

DETAILED DESCRIPTION OF THE INVENTION

Figure 1:
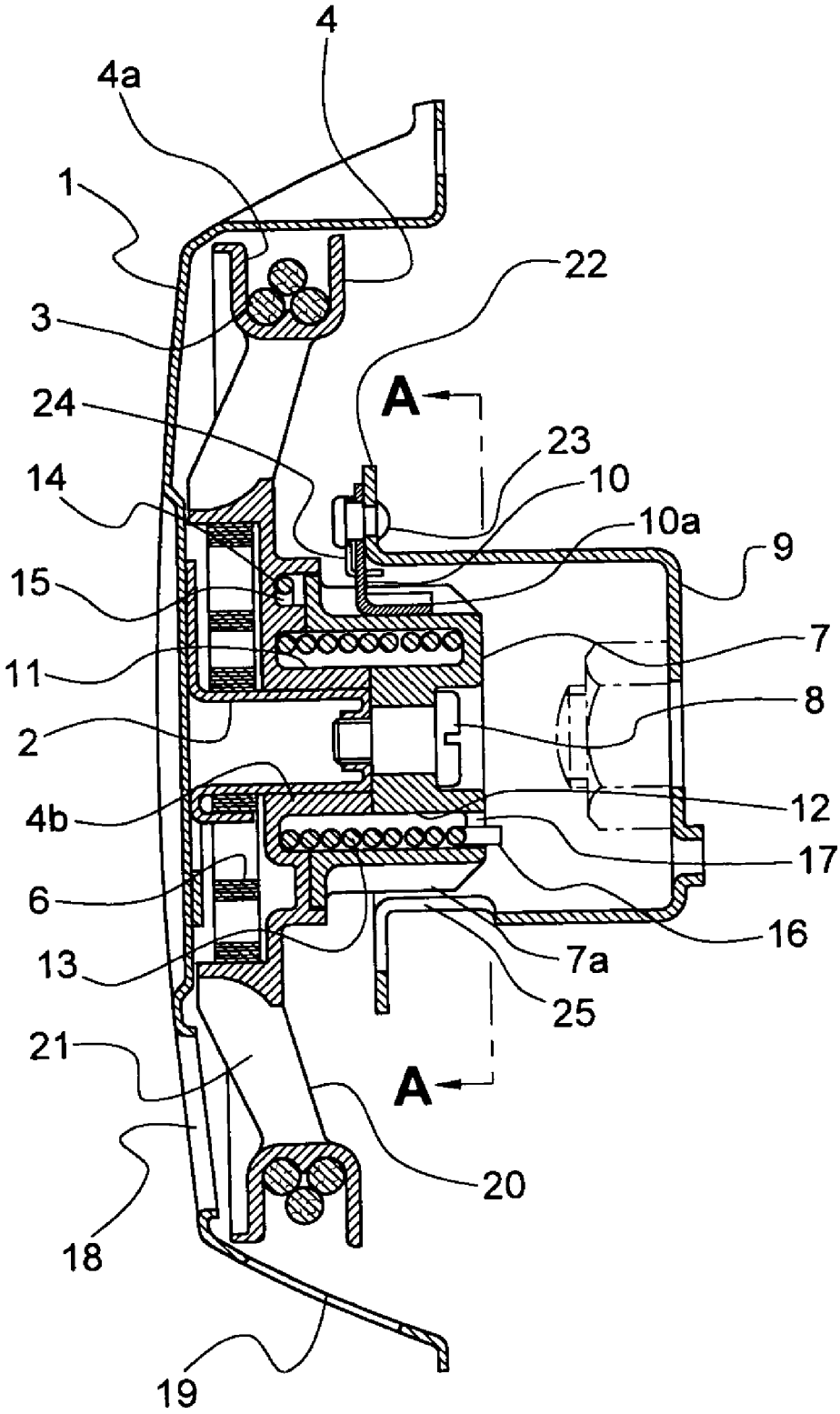
FIG. 1 is a sectional side elevation view showing a recoil starter according to an embodiment of the invention.
Figure 2:
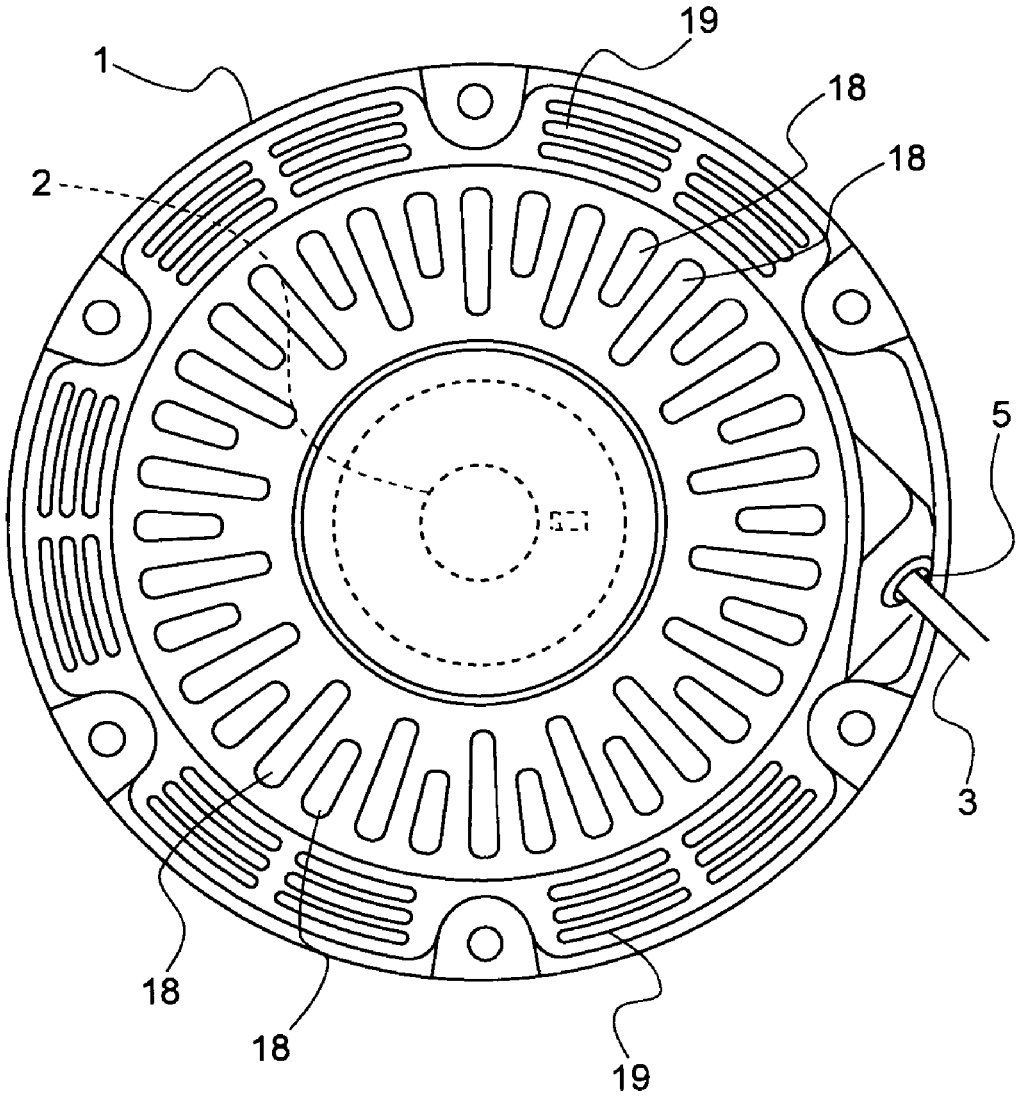
FIG. 2 is a front view of the recoil starter of FIG. 1.
Figure 3:
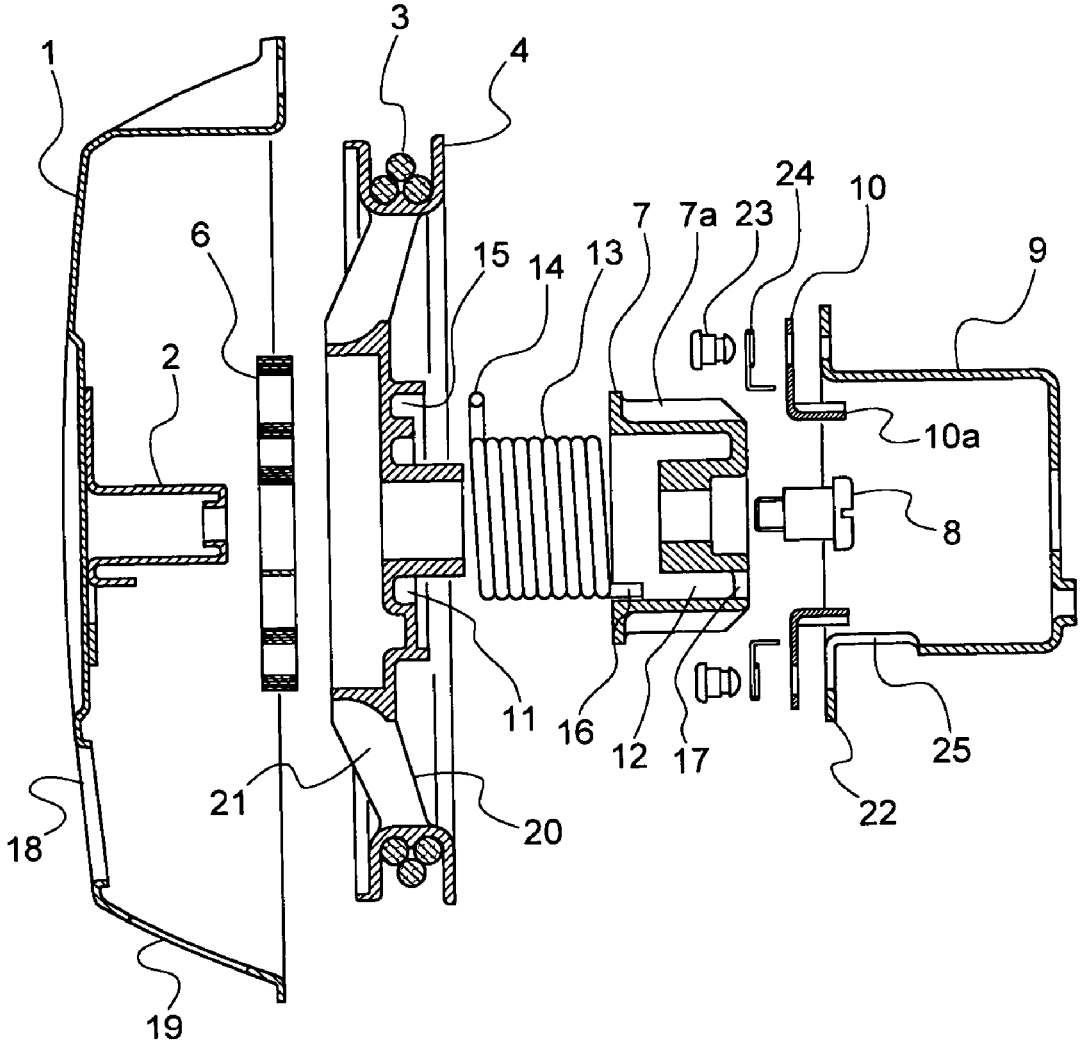
FIG. 3 is an exploded sectional side elevation view showing components constituting the recoil starter of FIG. 1.

An embodiment of the invention will be described below by way of example with reference to the drawings. As shown in FIGS. 1 to 3, a recoil starter of the illustrated embodiment includes a casing 1 which is formed so as to receive therein main components of the recoil starter and cover a side surface portion of an engine. The casing 1 is provided at an inner surface of a side wall thereof with a reel shaft 2 which is formed so as to face and be coaxial with a crankshaft of the engine. A rope reel 4, which includes a drum portion 4*a* formed at an outer periphery thereof and which has a recoil rope 3 wound around the drum portion 4*a* thereof, is rotatably mounted to the reel shaft 2. One end of the recoil rope 3 wound around the drum portion 4*a* of the rope reel 4 is fixed to the rope reel 4 and, as shown in FIG. 2, the other end of the recoil rope 3 is pulled out to the outside of the casing 1 through an opening 5 formed in the casing 1. By pulling the other end of the recoil rope 3, the rope reel 4 is rotationally driven around the reel shaft 2.

A recoil spring 6 is disposed at an outer peripheral surface of the reel shaft 2 between a side surface of the rope reel 4 and the inner surface of the casing 1. The recoil spring 6 is adapted to rotate, in the opposite direction, the rope reel 4 which has been rotated in an engine starting direction by pulling the recoil rope 3, to thereby rewind the recoil rope 3 pulled out from the drum portion 4*a* around the rope reel 4. The recoil spring 6 has an inner-peripheral end thereof fixed to the reel shaft 2 and an outer-peripheral end thereof fixed to the rope reel 4. When the recoil rope 3 is pulled to rotate the rope reel 4, a rotational force is accumulated in the recoil spring 6. By releasing the recoil rope 3, the rope reel 4 is rotated in the opposite direction by the rotational force accumulated in the recoil spring 6, and the recoil rope 3 pulled out to the outside of the casing 1 is rewound around the rope reel 4.

A cam 7 that transmits a rotation of the rope reel 4 to the engine side is disposed so as to face an end surface of a boss portion 4*b* of the rope reel 4 rotatably supported at the reel shaft 2 of the casing 1. The cam 7 is supported by a screw 8 screwed into the reel shaft 2, so that the cam 7 can rotate concentrically with the rope reel 4. The cam 7 is provided on an outer peripheral surface thereof with a plurality of cam pawls 7*a*, which have respective engaging surfaces facing in the engine starting rotation direction and which are arranged along the circumferential direction, so as to transmit the rotation of the cam 7 to a drive pulley 9 constituting a rotating member attached to the crankshaft of the engine. The cam pawls 7*a* engage with a clutch mechanism provided at the drive pulley 9, whereby the rotation of the cam 7 is transmitted to the crankshaft of the engine via the drive pulley 9.

Figure 4:
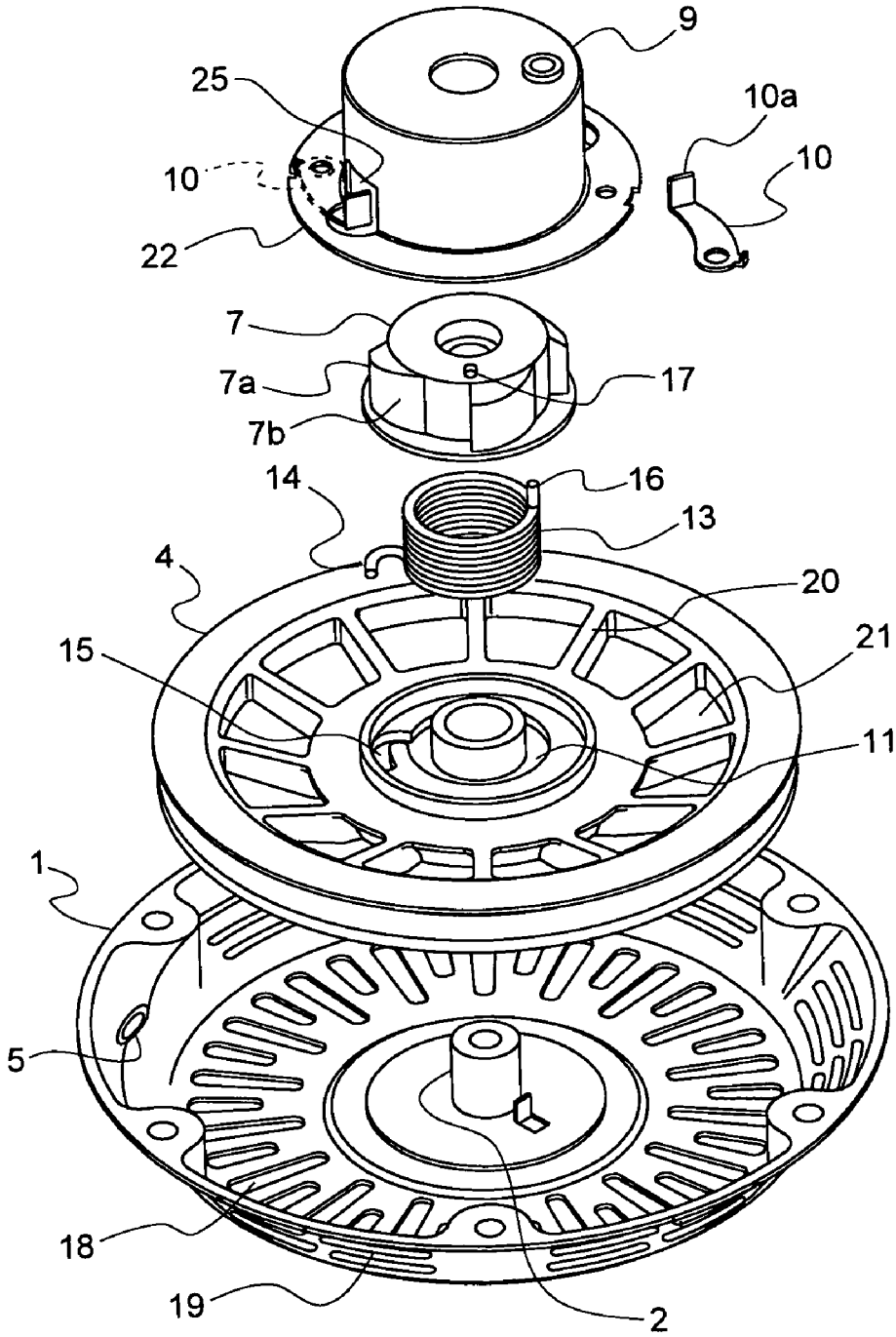
FIG. 4 is an exploded perspective view showing the configuration of main components of the recoil starter of FIG. 1.

Annular recesses 11 and 12 are respectively formed in mutually opposing side surfaces or joint surfaces of the boss portion 4*b* of the rope reel 4 and the cam 7 so that the annular recesses 11 and 12 face each other. A damper spring 13 that rotationally couples the rope reel 4 and the cam 7 together is received in the annular recesses 11 and 12. As shown in FIG. 4, the damper spring 13 is formed in the shape of a torsion coil spring and provided at one end thereof with an engaging end portion 14, which is formed by bending the end portion into a U-shape in a horizontal direction. The engaging end portion 14 is received in a holding groove 15 formed continuously with the outer periphery of the annular recess 11 of the rope reel 4, so that the rope reel 4 and the damper spring 13 are rotationally coupled to each other. Also, the damper spring 13 is provided at the other end thereof with another engaging end portion 16, which is formed by bending the end portion in the axial direction. The engaging end portion 16 is inserted through a holding hole 17 formed so as to penetrate the cam 7 from a bottom portion of the annular recess 12 of the cam 7 to an upper surface side of the cam 7, whereby the other end of the damper spring 13 is rotationally coupled to the cam 7. Thus, the cam 7 is rotated via the damper spring 13 in the forward rotation direction and the reverse rotation direction in association with the rotation of the rope reel 4.

As shown in FIG. 2, ventilation openings or air inlets 18 and 19 for introducing air for cooling the engine into the inside of the engine are formed in the side wall of the casing 1. In a state where the casing 1 is mounted to the engine while facing the crankshaft of the engine, outside air is permitted to be introduced into the inside of the engine along the crankshaft of the engine via the interior of the casing 1. A plurality of ribs 20 that extend in a radial direction are formed between the drum portion 4*a* formed at the outer periphery of the rope reel 4 and the boss portion 4*b* in which the annular recess 11 is formed such that air passages 21 that extend from one side of the rope reel 4 to the other side thereof are formed between the adjacent ribs 20.

The air passages 21 are formed to face the air inlets 18 formed in the casing 1. Cooling air that enters the air inlets 18 of the casing 1 passes through the air passages 21 of the rope reel 4 and flows into the engine. The air inlets 18 and 19 and the air passages 21 thus formed in the casing 1 and the rope reel 4, respectively ensure that cooling air passes therethrough, so that flowing of cooling air into the inside of the engine can be positively performed even when the rope reel 4 is formed to have a large outer diameter, with the result that cooling of the engine can be efficiently conducted.

The drive pulley 9 integrally coupled to the crankshaft of the engine has a cup form wherein an opening is formed at one end thereof. The drive pulley 9 is disposed so that, in a state where the casing 1 is attached to the engine, the cam pawls 7*a* formed projectingly on the outer peripheral surface of the cam 7 are located inside the cup of the drive pulley 9. An annular flange 22 is integrally formed on the drive pulley 9 in a manner to project radially outward from an end edge of an open end portion of the drive pulley 9. Centrifugal ratchets 10 constituting the clutch mechanism are pivotally supported by respective pins 23 at the annular flange 22. The centrifugal ratchets 10 are formed of a metal plate material. Each of the centrifugal ratchets 10 which has one end thereof pivotally supported by the pin 23 at a side surface of the annular flange 22 is provided at the other end thereof with an engaging piece 10*a* that is angled toward the inside of the cup of the drive pulley 9. The engaging pieces 10*a* of the centrifugal ratchets 10 engage with the respective cam pawls 7*a* of the cam 7, whereby the rotation of the cam 7 in the engine starting direction is transmitted to the drive pulley 9.

The centrifugal ratchets 10 are each urged in a direction in which the engaging piece 10*a* thereof engages with a corresponding one of the cam pawls 7*a* of the cam 7 by a torsion coil spring 24. When the cam 7 rotates in the engine starting direction, the engaging pieces 10*a* engage with the respective cam pawls 7*a*. After the engine has started, the drive pulley 9 is rotated by the engine, whereby the centrifugal ratchets 10 are pivotally turned in the direction in which they disengage from the cam pawls 7*a* by centrifugal force, so that the transmission of rotation between the drive pulley 9 and the cam 7 is cut off and the rotation of the engine is not transmitted to the recoil starter. In order to ensure that the centrifugal ratchets 10 can rotate in the direction in which the engaging pieces 10*a* thereof are moved away from the cam pawls 7*a* of the cam 7 by centrifugal force, cutout openings 25 are formed in a peripheral wall of the drive pulley 9 and portions of the annular flange 22. The engaging pieces 10*a* of the centrifugal ratchets 10 abut against respective edges 25*a* of the openings 15 formed in the annular flange 22, whereby the rotational angle of the centrifugal ratchets 10 in the moving-away direction is regulated.

A notch 26 that is adapted to hold the recoil rope 3 is formed in an outer peripheral edge of the annular flange 22 of the drive pulley 9. The notch 26 is used for holding the end portion of the recoil rope 3 on the drive pulley 9 when, in a state where the recoil starter has been detached from the engine because of a breakdown in the recoil starter or the like, the drive pulley 9 is rotated to start the engine by directly winding the recoil rope 3 around the drive pulley 9 and pulling the recoil rope 3.

Figure 5:
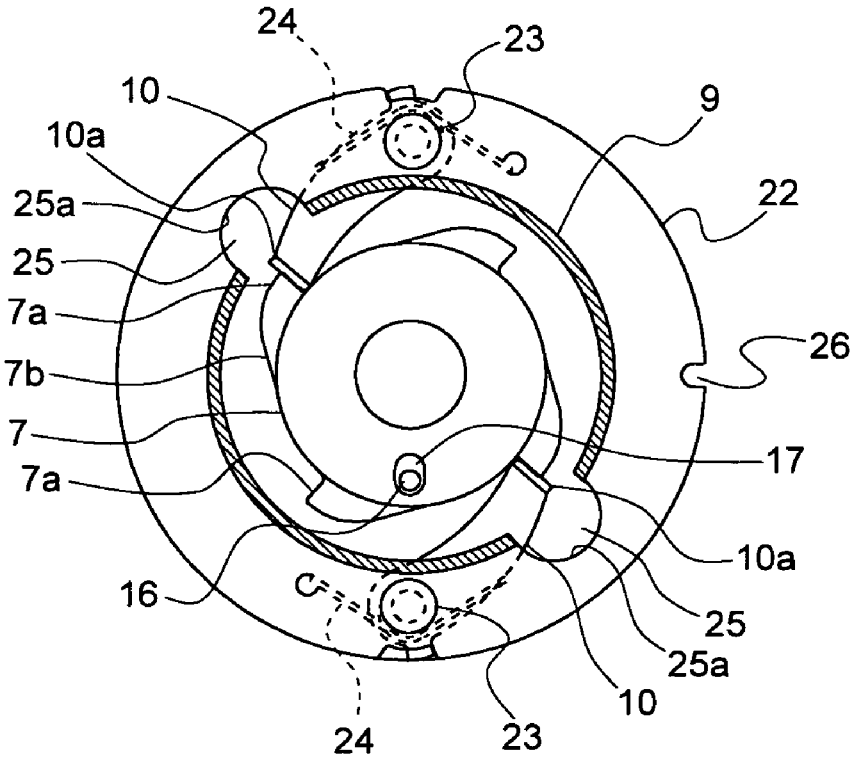
FIG. 5 is a cross-sectional view taken along line A—A of FIG. 1, showing the state of centrifugal ratchets and a cam before an engine is started.

Next, the operation of the recoil starter of the illustrated embodiment will be described. Prior to the starting operation of the engine, as shown in FIG. 5, the centrifugal ratchets 10 are urged in the direction in which the engaging pieces 10*a* thereof engage with the respective cam pawls 7*a* of the cam 7 due to the action of the torsion coil springs 24 and are disposed at positions where the engaging pieces 10*a* thereof can abut against the cam pawls 7*a* of the cam 7. When the rope reel 4 is rotated in the engine starting direction by pulling the recoil rope 3, the cam 7 is integrally rotated with the rope reel 4 via the damper spring 13, the cam pawls 7*a* of the cam 7 abut against the respective engaging pieces 10*a* of the centrifugal ratchets 10, whereby the drive pulley 9 is rotated by the cam 7 via the centrifugal ratchets 10, with the result that the crankshaft of the engine coupled to the drive pulley 9 is rotated.

Although the rotational load of the drive pulley 9 is increased due to a starting resistance of the engine and the load of the cam 7 becomes large, shock is not directly transmitted to the recoil rope 3 because the damper spring 3 is twisted to absorb this load. Also, at this time, the rotational force of the rope reel 4 is accumulated in the damper spring 13.

Figure 6:
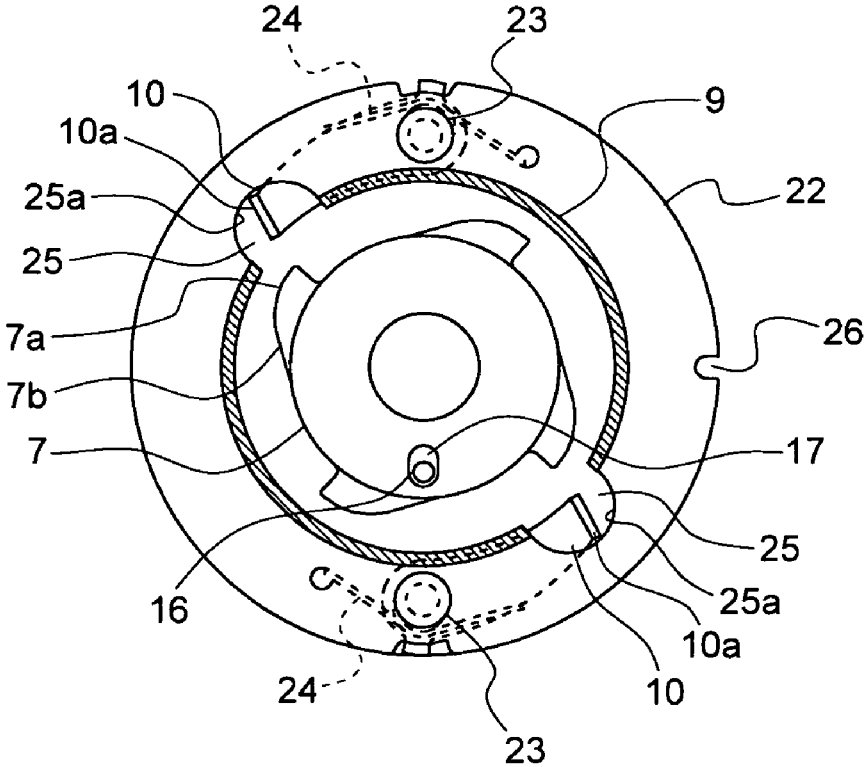
FIG. 6 is a cross-sectional view taken along line A—A of FIG. 1, showing the state of the centrifugal ratchets and the cam after the engine has been started.

When the rope reel 4 is further rotated and the rotational force exceeds the starting resistance of the engine, the rotational force of the rope reel 4 resulting from the pulling of the recoil rope 3 and the rotational force accumulated in the damper spring 13 are released to the cam 7 and then transmitted to the drive pulley 9 via the centrifugal ratchets 10, whereby the crankshaft is abruptly rotated to start the engine. When the engine starts and the drive pulley 9 is rotated via the crankshaft, as shown in FIG. 6, the centrifugal ratchets 10 pivotally turn outward due to the action of centrifugal force to permit the engaging pieces 10*a* thereof to disengage and move away from the cam pawls 7*a* of the cam 7, so that the rotation of the engine is not transmitted to the cam 7. When the recoil rope 3 is slacked after the engine has started, the rope reel 4 is rotated in the opposite direction by the rotational force accumulated in the recoil spring 6, whereby the recoil rope 3 is rewound around the rope reel 4.

Although the cam 7 is integrally rotated with the rope reel 4 in the opposite direction at this time via the damper spring 13, after the engine has started, the centrifugal ratchets 10 are pivotally turned outward to move the engaging pieces 10*a* thereof away from the cam pawls 7*a* of the cam 7 as described above. Therefore, the cam 7 can be rotated without contacting the centrifugal ratchets 10. Even when the recoil rope 3 is rewound in order to start the engine again in a case where the engine could not be started, the cam 7 is integrally rotated with the rope reel 4 in the opposite direction via the damper spring 13, but the rotation of the cam 7 and the rope reel 4 in the opposite direction is not prevented because the centrifugal ratchets 10 abut against inclined surfaces 7*b* formed at rear surfaces of the cam pawls 7*a* of the cam 7 to be pivotally turned outward counter to the urging force of the torsion coil springs 24.

Due to the engine starting, air for cooling the engine is introduced into the inside of the engine via the air inlets 18 and 19 formed in the casing 1 and the air passages 21 formed in the rope reel 4 by a fan formed at a flywheel magnet or the like which is rotated by the crankshaft of the engine, whereby the engine is cooled.

As described above, according to the recoil starter of the present invention, the damper spring that is disposed between the rope reel and the cam to transmit the rotational force of the rope reel to the cam using a resilient action is received in the annular recesses formed in the mutually opposing joint surfaces of the rope reel and the cam so as to face each other while the opposite ends of the damper spring are respectively held at the rope reel and the cam so that the rope reel and the cam are rotationally coupled together via the damper spring. Such construction facilitates the manufacture and assembly of the damper spring for buffering and accumulation of force, so that the manufacturing costs of the recoil starter can be reduced.

Moreover, the air inlets for introducing air for cooling the engine are formed in the side wall of the casing and the air passages are formed between the boss portion and the drum portion of the rope reel received in the casing in a manner to face the air inlets of the casing. Thus, even when the rope reel is formed to have a large outer diameter in order to reduce the pulling load of the recoil rope, the flowing of the cooling air for the engine is not blocked by the casing and the rope reel, so that the cooling air can pass through the recoil starter and be introduced into the inside of the engine, resulting in cooling of the engine being efficiently conducted.

Additionally, in one embodiment of the present invention, the clutch mechanism comprises: the cam pawl formed projectingly on the outer peripheral surface of the cam; the drive pulley that has a cup form with one end thereof open, and disposed so as to cover the cam; and the centrifugal ratchet having one end thereof pivotally supported at the annular flange formed on the open end portion of the drive pulley in a manner to project radially outward therefrom and provided on the other end thereof with the engaging piece formed to be angled toward the inside of the drive pulley. Such construction enables the assembled dimensions of the rope reel and the cam to be reduced, so that the dimensions of the recoil starter can be reduced, resulting in size and weight reduction being achieved.

Moreover, the engaging piece that engages with the cam pawl of the cam is formed, so as to be angled toward the inside of the drive pulley, at the other end of the centrifugal ratchet which has the one end pivotally supported at the annular flange. Therefore, the engaging piece can be made to engage at a center portion of the cam pawl, so that it becomes possible to stabilize the operation of the centrifugal clutch mechanism constituted by the centrifugal ratchet. Also, the centrifugal ratchet is arranged in the interior of the drive pulley having a cup form. Accordingly, in the event that the recoil starter becomes broken, the centrifugal ratchet does not become a hindrance when the recoil starter is detached from the engine and the rope is directly wound around the drive pulley to start the engine, whereby the starting operation can be conducted safely.

While an illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A recoil starter comprising:

a casing including a reel shaft disposed coaxially with a crankshaft of an engine, which crankshaft has a rotating member coupled thereto;

a rope reel rotatably supported on said reel shaft and provided at an outer periphery thereof with a drum portion around which a recoil rope is wound;

a recoil spring for rotationally urging said rope reel in a direction in which said recoil rope is rewound;

a cam, rotatably supported on said reel shaft, for transmitting a rotation thereof to said rotating member via a clutch mechanism; and a damper spring, disposed between said rope reel and said cam, for transmitting a rotation of said rope reel to said cam using a resilient action, wherein annular recesses are formed in mutually opposing joint surfaces of said rope reel and said cam, respectively, in a manner to face each other, said damper spring being received in said annular recesses while opposite ends of said damper spring are respectively held at said rope reel and said cam so that said rope reel and said cam are rotationally coupled together via said damper spring;

said casing includes a side wall having air inlets formed therein for introducing air for cooling the engine; and said rope reel includes a boss portion which forms the annular recess of said rope reel, said rope reel having air passages which are formed between said drum portion and said boss portion thereof in such a manner as to face said air inlets formed in said casing, the boss portion of the rope reel and the cam have outer walls which form the respective annular recesses and which are located radially inwardly of the air passages and the damper spring comprises a torsion coil spring.

2. The recoil starter according to claim 1, wherein said clutch mechanism for transmitting the rotation of said cam to said rotating member comprises:

a cam pawl formed projectingly on an outer peripheral surface of said cam;

a drive pulley which constitutes said rotating member and which has a cup form with its one end open, said drive pulley being disposed in such a manner as to cover said cam; and a centrifugal ratchet having one end thereof pivotally supported at an annular flange which is formed on an open end portion of said drive pulley in a manner to project radially outward therefrom, said centrifugal ratchet being provided on the other end thereof with an engaging piece formed to be angled toward the inside of said drive pulley, said centrifugal ratchet being rotationally urged in a direction in which said engaging piece thereof engages with said cam pawl of said cam.

3. The recoil starter according to claim 1 wherein said rope reel air passages are located radially outward from the torsion coil spring to provide an open passageway free from any intrusion by the torsion coil spring.

4. The recoil starter according to claim 1 wherein the casing has an outer convex surface with an inclined annular flange extending from the side wall with ventilation air inlets formed on the annular flange.

5. A recoil starter comprising:

a casing including a reel shaft disposed coaxially with a crankshaft of an engine, which crankshaft has a rotating member coupled thereto;

a rope reel rotatably supported on said reel shaft and provided at an outer periphery thereof with a drum portion around which a recoil rope is wound;

a recoil spring for rotationally urging said rope reel in a direction in which said recoil rope is rewound;

a cam, rotatably supported on said reel shaft, for transmitting a rotation thereof to said rotating member via a clutch mechanism; and a damper spring, disposed between said rope reel and said cam, for transmitting a rotation of said rope reel to said cam using a resilient action, wherein annular recesses are formed in mutually opposing joint surfaces of said rope reel and said cam, respectively, in a manner to face each other, said damper spring being received in said annular recesses while opposite ends of said damper spring are respectively held at said rope reel and said cam so that said rope reel and said cam are rotationally coupled together via said damper spring;

said casing includes a side wall having air inlets formed therein for introducing air for cooling the engine;

said rope reel includes a boss portion which forms the annular recess of said rope reel, said rope reel having air passages which are formed between said drum portion and said boss portion thereof in such a manner as to face said air inlets formed in said casing; and a clutch mechanism for transmitting the rotation of said cam to said rotating member including:

a cam pawl formed projectingly on an outer peripheral surface of said cam;

a drive pulley which constitutes said rotating member and which has a cup form with its one end open, said drive pulley being disposed in such a manner as to cover said cam; and a centrifugal ratchet having one end thereof pivotally supported at an annular flange which is formed on an open end portion of said drive pulley in a manner to project radially outward therefrom, said centrifugal ratchet being provided on the other end thereof with an engaging piece formed to be angled toward the inside of said drive pulley, said centrifugal ratchet being rotationally urged in a direction in which said engaging piece thereof engages with said cam pawl of said cam.

6. A recoil starter comprising:

a casing including a reel shaft disposed coaxially with a crankshaft of an engine, which crankshaft has a rotating member coupled thereto;

a rope reel rotatably supported on said reel shaft and provided at an outer periphery thereof with a drum portion around which a recoil rope is wound;

a recoil spring for rotationally urging said rope reel in a direction in which said recoil rope is rewound;

a cam, rotatably supported on said reel shaft, for transmitting a rotation thereof to said rotating member via a clutch mechanism;

a damper spring, disposed coaxially between said rope reel and said cam, for transmitting a rotation of said rope reel to said cam using a resilient action, said casing includes a side wall having air inlets formed therein for introducing air for cooling the engine;

said rope reel includes a boss portion which forms an annular recess of said rope reel, said rope reel having air passages which are formed between said drum portion and said boss portion thereof in such a manner as to face said air inlets formed in said casing;

the air passages are positioned radially outward from the damper spring without any blocking of the air passages and air inlets by the damper spring; and a clutch mechanism for transmitting the rotation of said cam to said rotating member including:

a cam pawl formed projectingly on an outer peripheral surface of said cam;

a drive pulley which constitutes said rotating member and which has a cup form with its one end open, said drive pulley being disposed in such a manner as to cover said cam; and a centrifugal ratchet having one end thereof pivotally supported at an annular flange which is formed on an open end portion of said drive pulley in a manner to project radially outward therefrom, said centrifugal ratchet being provided on the other end thereof with an engaging piece formed to be angled toward the inside of said drive pulley, said centrifugal ratchet being rotationally urged in a direction in which said engaging piece thereof engages with said cam pawl of said cam.

* * * * *